US006263084B1

(12) United States Patent
Cressman et al.

(10) Patent No.: US 6,263,084 B1
(45) Date of Patent: Jul. 17, 2001

(54) POWER AMPLIFIER AND LOUDSPEAKER FRAME INTEGRATION

(75) Inventors: Karl W. F. Cressman, Columbus; Richard Dennis Fay, Bloomington, both of IN (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

(21) Appl. No.: 08/815,638

(22) Filed: Mar. 13, 1997

Related U.S. Application Data

(63) Continuation of application No. 08/535,657, filed on Sep. 28, 1995, now abandoned.

(51) Int. Cl.[7] ..... H04R 25/00

(52) U.S. Cl. ..... 381/164; 381/117; 381/397

(58) Field of Search ..... 381/88, 89, 90, 381/96, 111, 159, 192, 194, 195, 196, 197, 199, 201, 87, 332, 345, 161, 164, 397

(56) References Cited

U.S. PATENT DOCUMENTS

| | | | | |
|---|---|---|---|---|
| 2,551,447 | * | 5/1951 | Marquis | 381/199 |
| 3,319,201 | * | 5/1967 | Coen | 381/201 |
| 4,068,103 | * | 1/1978 | King et al. | 381/194 |
| 4,567,959 | | 2/1986 | Prophit . | |
| 4,592,087 | | 5/1986 | Killion . | |
| 4,625,328 | | 11/1986 | Freadman . | |
| 4,727,583 | | 2/1988 | Weber . | |
| 4,811,403 | * | 3/1989 | Henricksen et al. | 381/159 |
| 4,933,975 | * | 6/1990 | Button | 381/194 |
| 5,097,513 | | 3/1992 | Jordan et al. . | |
| 5,166,982 | | 11/1992 | Shintaku . | |

FOREIGN PATENT DOCUMENTS

| | | |
|---|---|---|
| 296 08 421 U | 12/1996 | (DE) . |
| 0122663 | 10/1984 | (EP) . |
| S49-45291 | 12/1974 | (JP) . |
| 59-189796 | 10/1984 | (JP) . |
| S59-189796 | 10/1984 | (JP) . |
| 63-253799 | 10/1988 | (JP) . |
| H4-53112 | 12/1992 | (JP) . |

* cited by examiner

*Primary Examiner*—Curtis Kuntz
*Assistant Examiner*—Suhan Ni
(74) *Attorney, Agent, or Firm*—Barnes & Thornburg

(57) ABSTRACT

An integrated amplifier and speaker system includes a speaker having a motor assembly and a frame. A power stage of the amplifier is mounted in thermal communication with the motor assembly and/or the frame. Heat generated by the power stage is thereby sunk to the motor assembly and frame.

8 Claims, 4 Drawing Sheets

POWER AMPLIFIER AND LOUDSPEAKER FRAME INTEGRATION

This application is a continuation of application Ser. No. 08/535,657, filed Sep. 28, 1995, now abandoned.

This invention relates to a combination amplifier and speaker system. More specifically this invention relates to a combination amplifier and speaker system wherein the speaker itself performs a heat sinking function for the amplifier.

Conventional audio systems contemplate a separate speaker and amplifier. Generally, a heat sink associated with the amplifier dissipates heat generated by (a) power stage(s) of the amplifier. Generally, the heat sink is selected based upon the maximum power handling requirements of the power stage(s). Therefore, for (a) particular power stage(s), the heat sink must have a heat dissipating capability sufficient to maintain the temperature of the power stage(s) at or below the desired maximum temperature level at any output. For high power amplifiers, this separate heat sink often increases the cost and the bulk of the audio system. A not insubstantial portion of the bulk of an audio system may be traceable to the heat sink(s) for the power stage(s).

An object of this invention is to integrate a speaker and an amplifier, so that the speaker functions as a heat sink in order to reduce the bulk associated with the speaker/amplifier combination.

According to the invention, an integrated amplifier and speaker combination is provided. The combination comprises a speaker including a frame and motor assembly. A power amplifier is mounted on the motor assembly in heat conducting relationship therewith. The heat generated by the power amplifier is conducted from the power amplifier to the speaker motor assembly. Thus, the thermal characteristics of the motor assembly and frame of the loudspeaker sinks heat generated by the operation of the power amplifier.

Illustratively, according to the invention the motor assembly includes a front plate providing a projection which extends outwardly from the motor assembly. The projection serves as a mounting for (a) power stage(s) of the power amplifier. Heat generated by the power stage(s) is transferred through the projection, the front plate, the magnet and the back plate of the motor assembly and the frame, all of which are coupled together in heat conducting relationship with each other. Frequently, an electrical insulator will be provided between the power stage(s) and the projection to isolate, for example, the case of the power stage(s) electrically from the speaker.

A heat transfer bracket can be positioned between the motor assembly and the power stage(s) in heat conducting relationship with both. The bracket permits electrical isolation to be effected either between the power stage(s) and the bracket or between the bracket and the motor assembly, or both, at the circuit designer's option. The bracket also provides flexibility in mounting orientations of the power stage(s) with respect to the speaker. The bracket may also provide a heat spreading function.

According to an illustrative embodiment of the invention, the motor assembly includes a pot-shaped shell, a permanent magnet and a core tip. A thermally conductive bracket is mounted in thermal communication with the pot-shaped shell. The power stage is mounted in thermal communication with the bracket.

Illustratively, a thermally conductive material is interposed between the bracket and the pot-shaped shell to promote thermal communication between the bracket and the pot-shaped shell.

The invention may best be understood by referring to the following detailed description and accompanying drawings which illustrate the invention. In the drawings.

In the descriptions of illustrated embodiments that follow, the same reference numbers have been used to refer to those elements of each embodiment which perform the same or similar functions.

Figure 1:
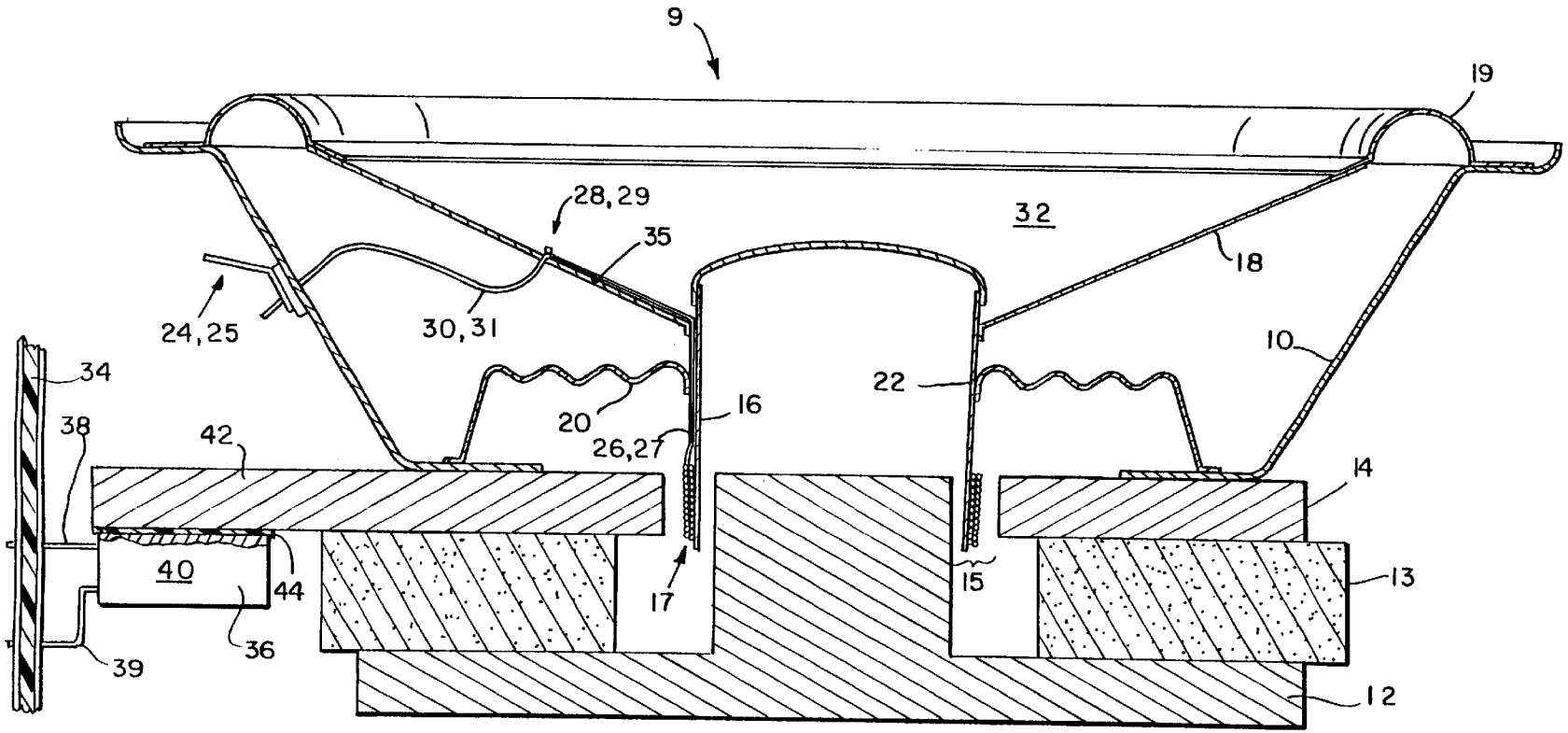
FIG. 1 illustrates a fragmentary cross-section through components of a power amplifier and speaker combination constructed according to the invention.

Referring to FIG. 1, an amplifier and speaker combination includes a speaker 9 having a supporting frame 10 and a motor assembly comprising a backplate/center pole 12, a permanent magnet 13, and a front plate 14 providing a substantially uniform magnetic field across an air gap 15. A voice coil former 16 supports a voice coil 17 in the magnetic field. Current related to the program material to be transduced by the speaker 9 drives the voice coil 17, causing it to reciprocate axially in the air gap 15 in a known manner. A cone 18 attached at its apex to an end of the coil former 16 lying outside the motor assembly is coupled by a surround 19 at its outer perimeter to the frame 10. A spider 20 is coupled at its outer perimeter to the frame 10. The spider 20 includes a central opening 22 to which the voice coil former 16 is attached. The suspension including the surround 19 and spider 20 constrains the voice coil 17 to reciprocate axially in the air gap 15.

A typical configuration for completing the electrical connection between the loudspeaker terminals 24, 25 and the voice coil wires 26, 27 is illustrated in FIG. 1. The voice coil wires 26, 27 are dressed against the side of the coil former 16, and pass through central opening 22 and the intersection of the coil former 16 and the apex of the cone 18. Wires 26, 27 are then dressed across the face 32 of the cone 18 to the points 28, 29 on the face of the cone 18 where they are connected to the flexible conductors 30, 31. Connections 28, 29 are made by any of a number of available techniques. The coil wires 26, 27 typically are fixed to the face 32 of the cone 18 with (an) electrically non-conduction adhesive(s) 35.

Referring to FIG. 1, a typical power amplifier and speaker combination includes a printed circuit board 34 and one or more power stages 36. The power stage(s) 36 is(are) electrically connected by wires 38, 39 to the printed circuit board 34. The case 40 of a power stage 36 may also act as a terminal of stage 36, supplying, for example, non-zero operating potential to power stage 36. It is contemplated that a very wide variety of power amplifiers typically used in audio systems may be used in accordance with the invention.

The power stage 36 is mounted on the front plate 14 of the motor assembly. Illustratively, the front plate 14 is fixed, for example, by (a) suitable adhesive(s) in a magnetic circuit and in thermally and electrically conductive relation with the permanent magnet 13 and backplate 12. A projection 42 is provided on the front plate 14. The power stage 36 is secured on the projection 42 in heat conducting relation with front plate 14. An electrical insulator 44 which is a thermal conductor is interposed between the power stage 36 and front plate 14 to isolate the power stage 36 electrically from the motor 12, 13, 14 and speaker frame 10 while permitting heat flow across insulator 44. A suitable material would be a thin mica sheet. This insulator 44 is often necessary because, as previously noted, the case 40 of power stage 36 may be at some non-zero voltage with respect to speaker 9 during power amplifier operation. It is understood that the insulator 44 may be selected from a wide variety of materials commonly used in electronic circuits, so long as the insulator does not significantly inhibit thermal conduction therethrough. Thermally conductive paste-like compounds also are frequently spread between the adjacent surfaces of stage 36 and insulator 44 and insulator 44 and front plate 14 to ensure intimate contact between these components and thereby enhance heat flow across these junctions.

During operation of the power amplifier and speaker combination, the power stage(s) 36 of the amplifier generate (s) heat. This heat must be dissipated from the power stage(s) 36 in order to maintain the temperature of the power stage(s) 36 within a predetermined safe operating temperature range. To hold the temperature of the power stage(s) 36 within the safe operating temperature range, the power stage(s) 36 is(are) in heat conducting relationship with the front plate 14 of the motor assembly 12, 13, 14, and, by virtue of this, with the whole speaker motor assembly and speaker frame 10. Front plate 14 is formed to sink the heat from the power stage(s) 36 into the motor assembly 12, 13 14 and, where the frame 10 is constructed from a thermally conductive material, such as, for example, stamped steel, into frame 10. Thus, heat generated by the power stage(s) 36 flows through the projection 42 of the front plate 14 and thereby into the motor assembly 12, 13, 14 and frame 10. In this manner, heat produced by operation of the power stage(s) 36 is effectively dissipated by the entire motor assembly 12, 13, 14 and frame 10 of the integrated speaker and amplifier system.

Figure 2:
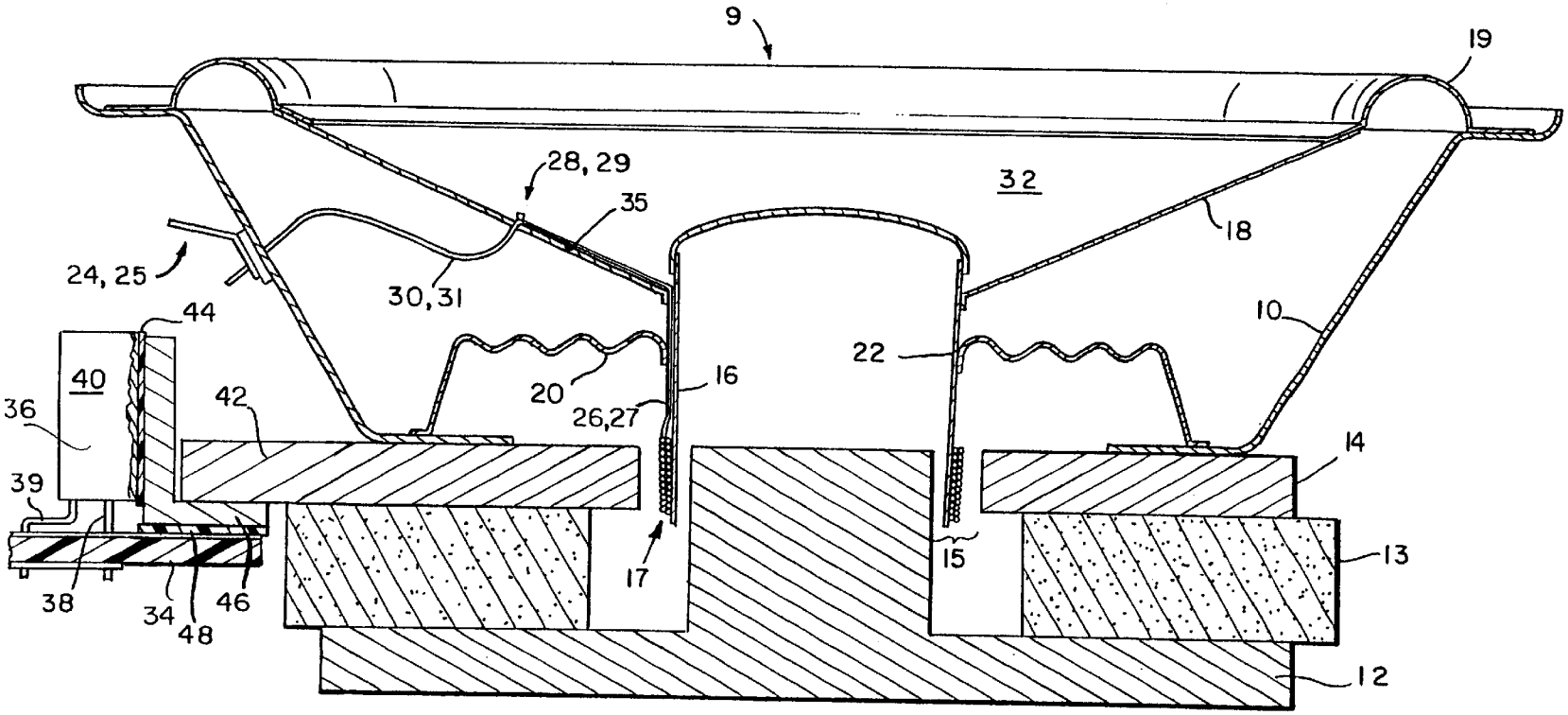
FIG. 2 illustrates a fragmentary cross-section through components of another power amplifier and speaker combination constructed according to the invention.

FIG. 2 illustrates another integrated speaker and amplifier system that includes a motor assembly having a thermally conductive bracket 46 mounted on the front plate 14. Illustratively, the bracket 46 is mounted on the projection 42 of the front plate 14 and the power stage(s) 36 is(are) mounted on the bracket 46. The illustrated bracket 46 is L-shaped and may extend over the perimetrally outer extent of the projection 42. However, it is understood that the bracket 46 may take on a wide variety of shapes and sizes to accommodate various orientations of the amplifier with respect to the speaker 9 in accordance with the invention so long as bracket 46 promotes heat flow between the power stage(s) 36 and the motor assembly 12, 13, 14 and frame 10.

As illustrated in FIG. 2, an electrical insulator 44 which is thermally conductive is interposed between the power stage 36 and the bracket 46 to isolate the power stage 36 electrically from the motor assembly 12, 13, 14 and frame 10 of the speaker. Illustratively, the printed circuit board 34 is also mounted on the bracket 46. Therefore, an electrical insulator 48, which ordinarily will also be thermally conductive, can also be provided between the bracket 46 and the printed circuit board 34 to isolate any circuit patterns on the printed circuit board 34 electrically from contact with bracket 46.

Figure 3:
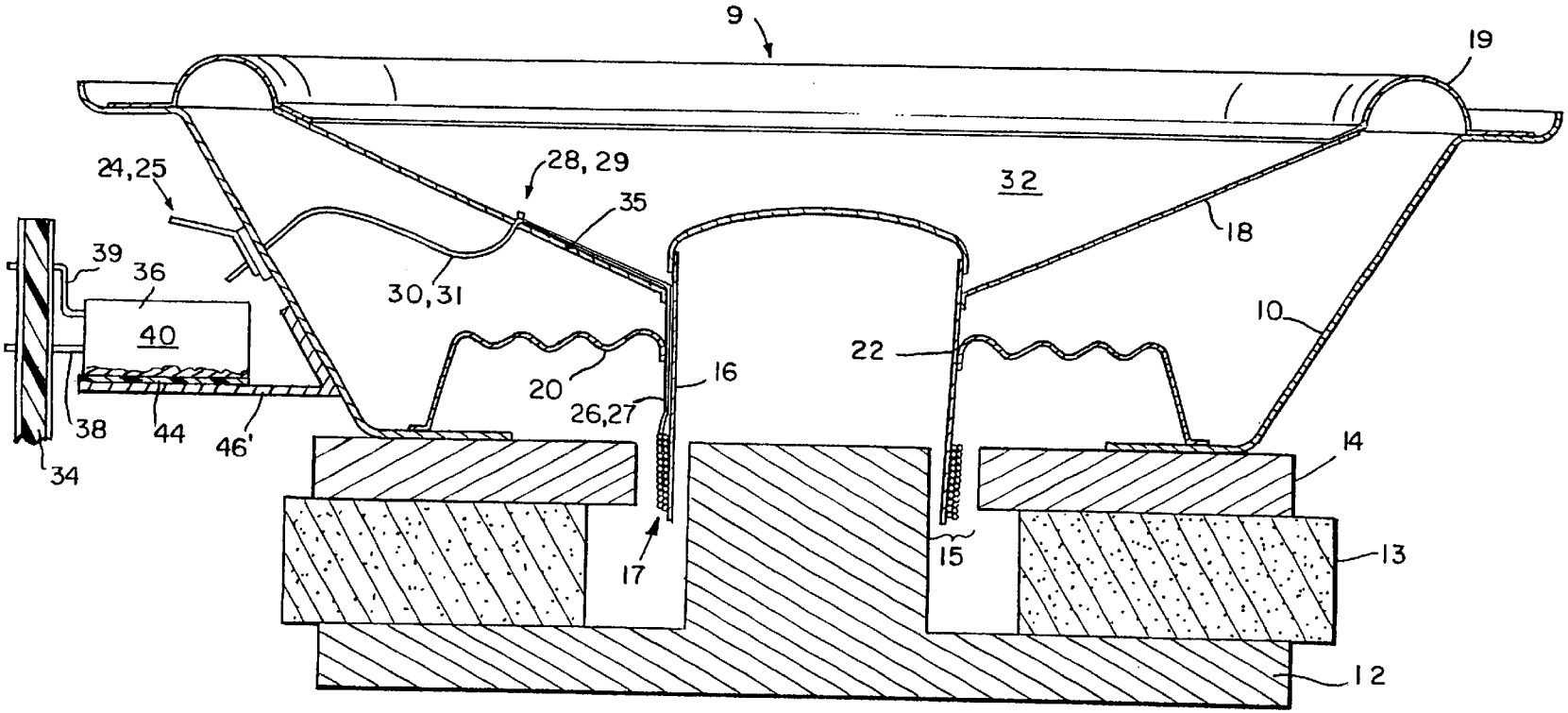
FIG. 3 illustrates a fragmentary cross-section through components of another power amplifier and speaker combination constructed according to the invention; and, FIG. 4 illustrates a fragmentary cross-section through components of another power amplifier and speaker combination constructed according to the invention.

FIG. 3 illustrates another configuration wherein the frame 10 is constructed from an electrically and thermally conductive material such as the previously mentioned stamped steel. A bracket 46' provided on frame 10 permits mounting of power stage(s) 36 to frame 10. Insulator 44 permits heat flow from power stage(s) 36 via insulator 44 and bracket 46' to frame 10 and motor assembly 12, 13, 14 to sink heat generated by the operation of power stage(s) 36.

Figure 4:
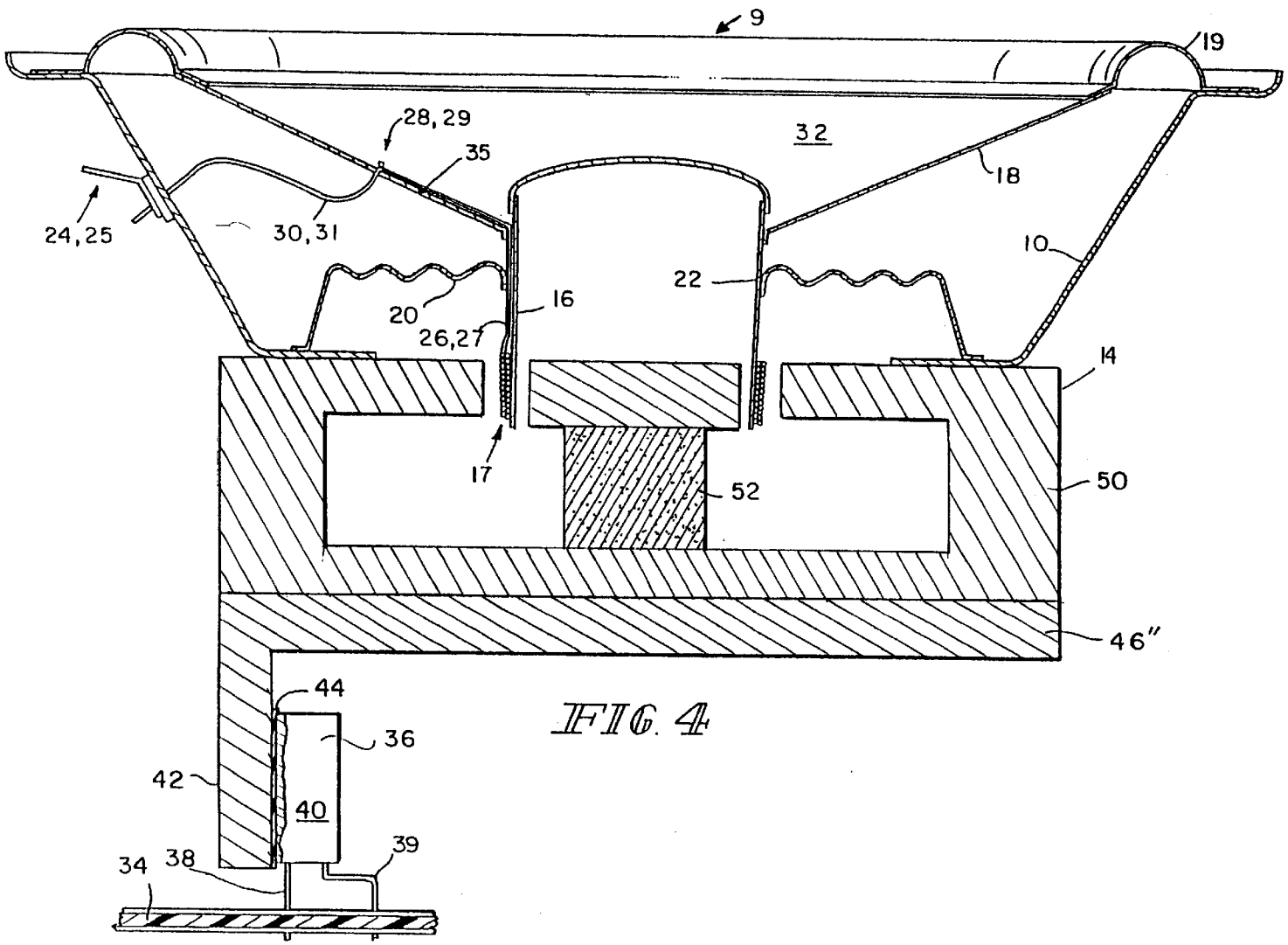

In the embodiment illustrated in FIG. 4, a pot shell 50 incorporates the functions of the front plate and back plate, other than the center pole. The center pole is provided by a permanent magnet 52 and a core tip 54. The air gap 15 is defined between the radially inner surface of the pot shell 50 and the radially outer surface of the core tip 54. The bracket 46" is attached to the back surface of the pot shell 50. Illustratively, all of the components 50, 52, 54 of the motor assembly and the bracket 46" can be joined by (a) threaded fastener(s), not shown. A thermally conductive compound can be applied to the abutting surfaces of pot shell 50 and bracket 46" to ensure good thermal contact between these two components of the assembled speaker 9.

What is claimed is:

1. An integrated amplifier and speaker apparatus comprising a speaker having a diaphragm, a motor assembly and a frame, the frame at least partly supporting the diaphragm for movement in the frame, the motor assembly including a front plate, a back plate, and a generally annular permanent magnet positioned between the front plate and the back plate, an amplifier having a power stage and a mounting for the power stage, the power stage mounting being attached in heat conducting connection to the power stage and to at least one of the front plate and frame so that heat generated by the power stage is conducted through the heat conducting connection to the at least one of the front plate and frame.

2. The apparatus of claim 1 wherein the power stage mounting comprises a thermally conductive material positioned between the at least one of the front plate and frame and the power stage.

3. The apparatus of claim 1 wherein the power stage mounting comprises a thermally conductive bracket, the bracket attached in heat conducting connection to the at least one of the front plate and frame, and the power stage attached in heat conducting connection to the bracket.

4. The apparatus of claim 3 further comprising a first thermally conductive material positioned between at least one of: the bracket and the at least one of the front plate and frame; and, the bracket and power stage.

5. The apparatus of claim 4 further comprising a second thermally conductive material positioned between the other of: the bracket and the at least one of the front plate and frame; and, the bracket and power stage.

6. The apparatus of claim 3 further comprising a printed circuit board, the power stage mounted in electrical communication with an electrical circuit provided on the printed circuit board.

7. The apparatus of claim 6 wherein the printed circuit board is mounted on the bracket.

8. The apparatus of claim 7 further comprising a thermally conductive electrical insulator positioned between the bracket and the power stage.

* * * * *